US005950288A

United States Patent [19]

Bach Lahor

[11] Patent Number: 5,950,288

[45] Date of Patent: Sep. 14, 1999

[54] URN FOR HOUSING OF ASHES

[76] Inventor: Santiago Bach Lahor, Placeta de la Creu, 15, 08221 Terrassa (Barcelona), Spain

[21] Appl. No.: 09/096,333

[22] Filed: Jun. 11, 1998

[30] Foreign Application Priority Data

Jun. 23, 1997 [ES] Spain ..... 9701736 U

[51] Int. Cl.[6] ..... A61G 17/00

[52] U.S. Cl. ..... 27/1; 40/721; 40/722; 40/124.5

[58] Field of Search ..... 40/725, 721, 722, 40/745, 757, 152, 124.5; 27/1

[56] References Cited

U.S. PATENT DOCUMENTS

| | | | |
|---|---|---|---|
| 1,225,195 | 5/1917 | Wanda | 40/722 |
| 2,072,167 | 3/1937 | Graham | 40/722 X |
| 4,199,848 | 4/1980 | Kohnert | 27/1 |
| 4,244,303 | 1/1981 | Kurasik | 40/722 X |
| 4,856,123 | 8/1989 | Hord | 40/722 |
| 5,218,774 | 6/1993 | Mullins | 40/722 |
| 5,787,625 | 8/1998 | Yesbick | 40/124.5 X |

*Primary Examiner*—Brian K. Green
*Assistant Examiner*—William L. Miller
*Attorney, Agent, or Firm*—Michael J. Striker

[57] ABSTRACT

An urn for inhumation ashes has a frame with a front area delimiting a large open space, an urn body adapted to store ashes and located in the open space, a graphic sheet located forwardly of the urn body, a transparent element located forwardly of the graphic sheet, and a rear protecting sheet arranged behind the urn body, the urn body, the graphic sheet, the transparent element and the rear protecting sheet being located inside the frame.

11 Claims, 3 Drawing Sheets

URN FOR HOUSING OF ASHES

BACKGROUND OF THE INVENTION

The present invention relates to an urn, specifically designed to house in an absolutely tight way, the ashes from inhumation.

The practice of inhumation is very broad, and it is supported by different directives of sanitary considerations and other practical considerations keeping in mind the lack of space in many places, which prevents enlargement of cemeteries or necropolis. Ashes from corpse inhumation are gathered in suitable containers, preferably in bowls and the like, with their appearance and finish concordant with the aim of respect and remembrance, especially when they are located in a privileged place within the family home. This practice which has been implemented for dead people has been also extended to pets. It is believed that it is advisable to further improve the urns for housing of ashes.

SUMMARY OF THE INVENTION

Accordingly, it is an object of the present invention to provide an urn for housing of ashes which ensures an absolute sealing of an area where the ashes are located and provides for a possibility to arrange a graphic element directly or indirectly referring to a human being or pet in a framed and protected manner, such as pictures of the human or pet, pictures of places or scenes of his/her life.

It is also an object of the present invention to provide such an urn which can be placed on a desk or suspended from a wall as desired.

In keeping with these objects and with others which will become apparent hereinafter, one feature of present invention resides, briefly stated, in an urn which has a frame with a front area delimiting a large open space; an urn body adapted to store ashes and located in the open space; a graphic sheet located forwardly of the urn body; a transparent element located forwardly of the graphic sheet; and a rear protecting sheet arranged behind the urn body, the urn body, the graphic sheet, the transparent element and the rear protecting sheet being located inside the frame.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
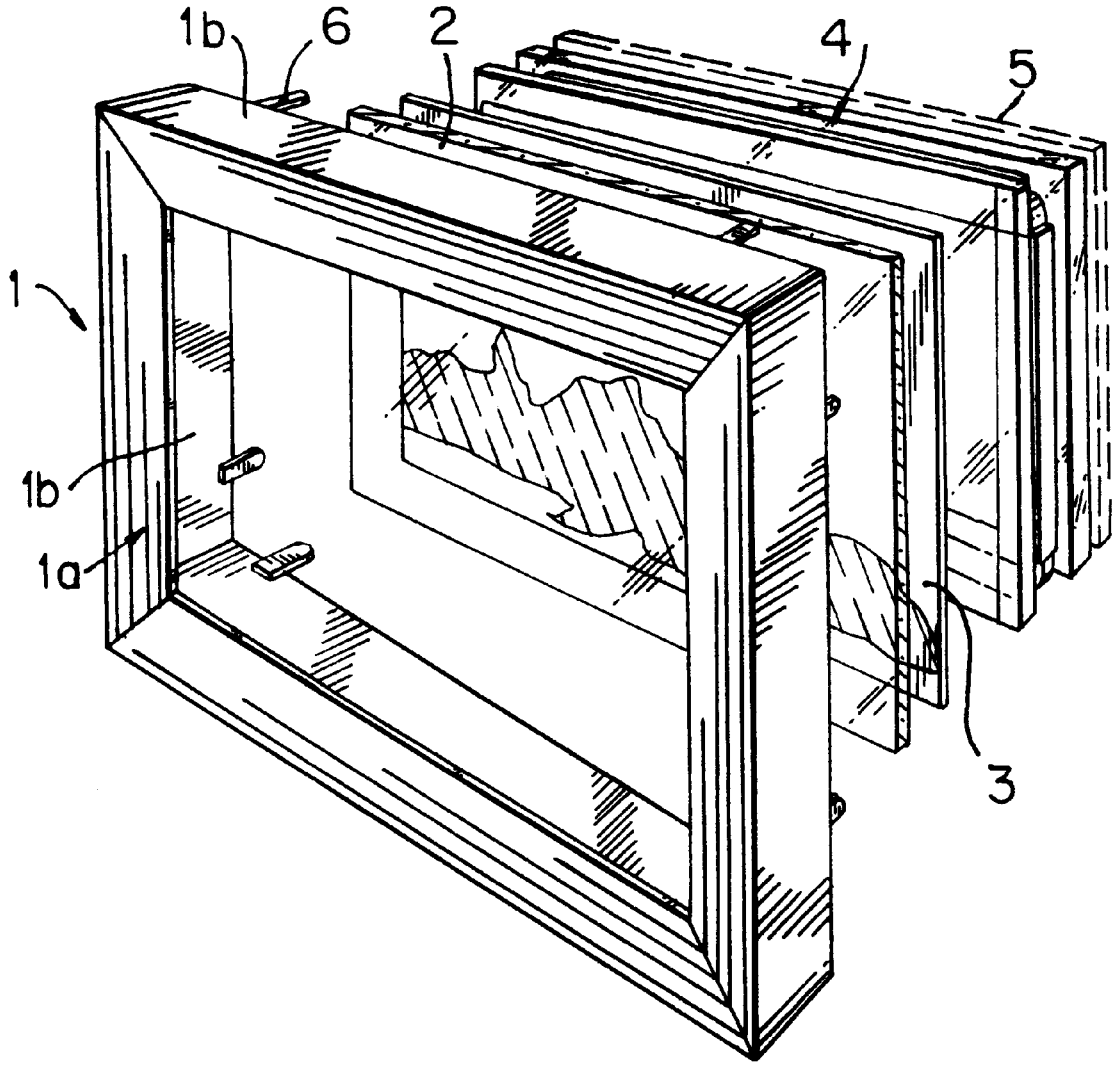
FIG. 1 is a perspective view of an exploded urn in accordance with the present invention.

An urn for inhumation ashes in accordance with the present invention includes a quadrangular frame 1 provided with a rim 1*a*. The frame 1 has a central quadrangular area which is completely open. The frame 1 has four sides 1*b* with a sufficient width to house a set of juxtaposed elements which together form the urn in accordance with the present invention.

A transparent glass 2 is provided immediately under the front rim 1*a*. It protects a sheet 3 which contains a concrete reference either of a person or a pet whose ashes are deposited in the urn, or a photographic or illustrated reference of places, objects or similar activities related to his/her life.

The urn body 4 is located behind the sheet 3. Alternatively, behind the urn body 4, a protecting and closing resistant sheet 5 is placed and tightly fastened by flanges 6. The flanges 6 are folded on the closing sheet 5 or simply on the urn body 4 so as to keep the rest of the elements within the frame 1 immobilized.

A ring 7 is placed on an upper edge 1*b* at the rear of the frame 1 for suspending the urn. If it is desired to place the urn on a horizontal surface, desk, shelving or the like, the rear closing sheet 5 is provided with a supporting bracket 8.

The urn body shown in FIGS. 24 is formed by two upright flat walls 9*a* and 9*b*. The walls are preferably transparent and kept separated so as to leave a recess between them. At the same time they are fastened by adherence to an internal housing formed by a lower internal crossbar 10*a* and two upright struts 11*a* and 11*b*. The struts are integral with the lower crossbar 10*a* at their ends by shins 12, whose stems at the right angle penetrate within the elements they make integral.

An upper crossbar 10*b* is composed of upright struts 12*a* and a horizontal strut 12*b*. The upright struts 12 are provided with teeth which make difficult an incidental separation of the elements of the urn body.

Figure 2:
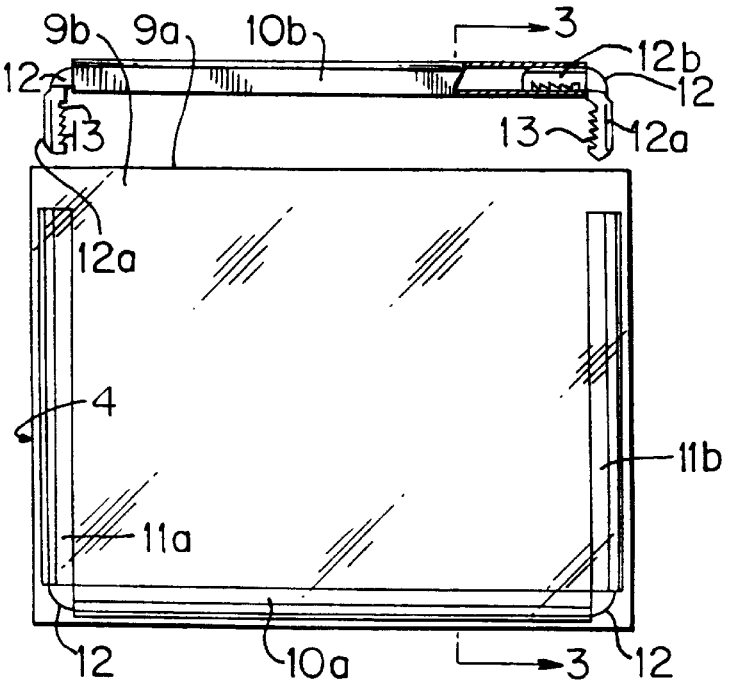
FIG. 2 is a partially exploded front view of a component of the inventive urn.
Figure 3:
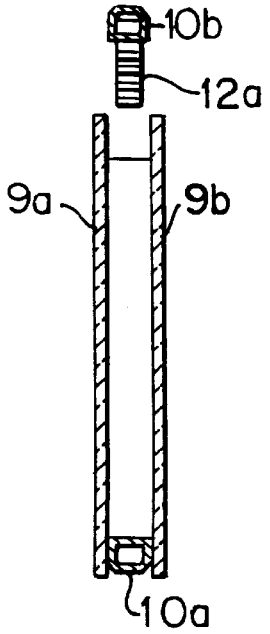
FIG. 3 is a side view of the inventive urn as seen in a section taken along the line A—A in FIG. 2.
Figure 4:
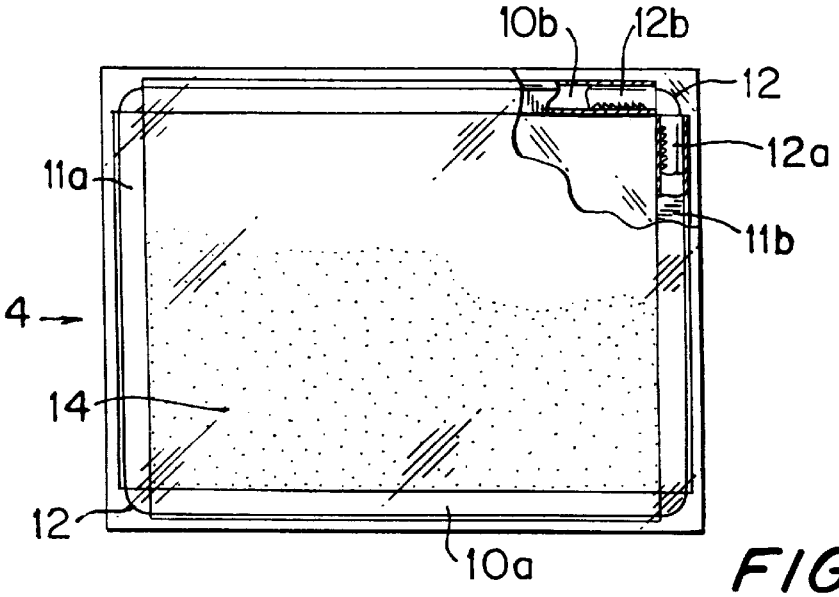
FIG. 4 is a view showing a fully assembled front view of the inventive urn which is partially sectioned in one corner.
Figure 5:
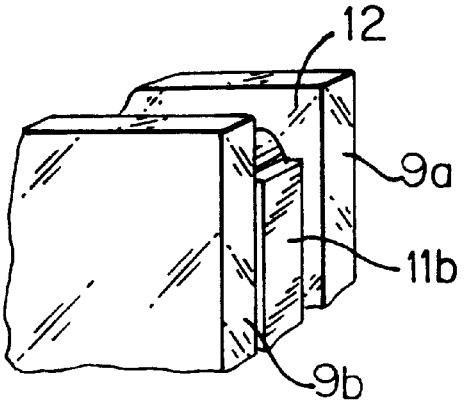
FIG. 5 is a perspective view of the sectioned corner of FIG. 4.
Figure 6:
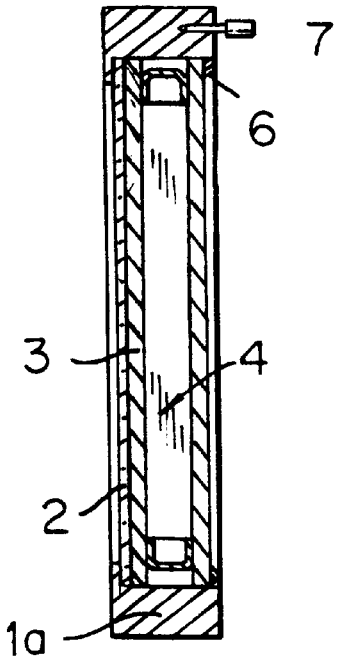
FIG. 6 is a view showing a side section of the inventive urn in accordance with an embodiment for placing as a suspended picture frame.
Figure 7:
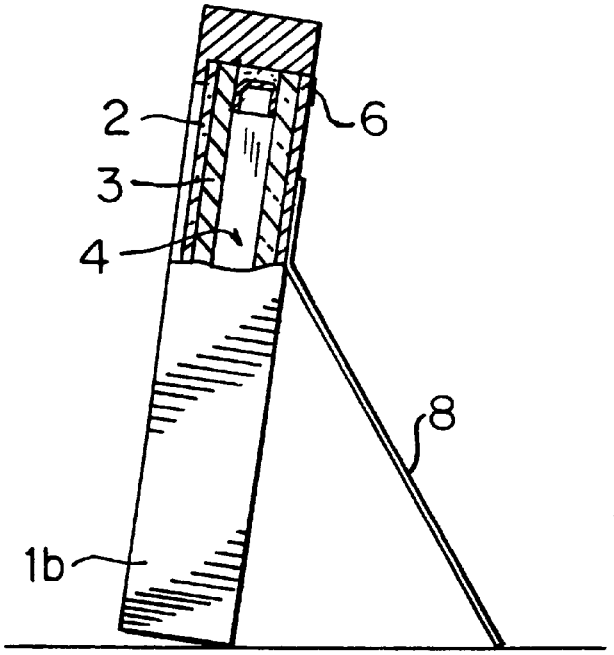
FIG. 7 is a side view of the inventive urn in a desk version, partially sectioned.

The upper crossbar 10*b* can be easily raised as shown in FIG. 2 to leave open the upper part of the recess formed between the transparent walls 9*a* and 9*b*. The upright stems 12*a* of the upper crossbar 10*b* are introduceable within the upright struts 11*a* and 11*b*, so as to completely close the recess as shown in FIG. 4, to keep a perfect tightness of the ashes 14 stored inside.

The urn in accordance with the present invention is handled as follows:

The closing protective rear sheet 5 of the urn body can be easily withdrawn from inside of the frame 1 together with the graphic sheet 3. Then, only the transparent glass 2 which allows to view the sheet 3 remains at the front area. By withdrawing upwardly of the upper crossbar 10*b*, the recess provided between the two transparent plates 9*a* and 9*b* remain accessible. This recess, within which the ashes 14 will be stored, remains delimited and closed by the housing formed by the lower cross bar 10*a* and the side struts 11*a* and 11*b*. Once the ashes 14 has been poured inside the urn body, the recess is closed by placing the upper crossbar 10*b* and embedding the upper stems 12*a* within the upright struts 11*a*, 11*b*. The ashes stored there will be viewed through the transparent upright walls 10*a* and 10*b*. Then the urn body 4 is placed within the frame 1, where it is protected and concealed. To achieve the total immobilization of the urn body relative to the frame, it can be sealed with silicone or the like.

It is believed to be clear that the frame and the remaining component elements of the inventive urn can have any geometrical shape, and even the urn body can adapt such a shape.

The inventive urn can have any ornaments and external appearances, sizes and shapes, as well as materials used.

It will be understood that each of the elements described above, or two or more together; may also find a useful application in other types of constructions differing from the types described above.

While the invention has been illustrated and described as embodied in urn for housing of ashes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An urn for inhumation ashes, comprising a frame with a front area delimiting a large open space; an urn body adapted to store ashes; a graphic sheet located forwardly of said urn body; a transparent element located forwardly of said graphic sheet; and a rear protecting sheet arranged behind said urn body, said urn body, said graphic sheet, said transparent element and said rear protecting sheet being located inside said space of said frame, said urn having an inner space which is closeable for keeping a perfect tightness of the ashes stored inside the urn, said urn having two upright walls, a first element which together with said upright walls delimits said inner space, and a second upper element which is removably connectable with said upright walls to close said inner space.

2. An urn as defined in claim 1, wherein said open space of said front area of said frame is a quadrangular open space and form a sealed enclosure.

3. An urn as defined in claim 1, wherein said transparent element is formed as a glass element.

4. An urn as defined in claim 1, wherein said rear protecting sheet is provided with folded flanges fastened on said frame.

5. An urn as defined in claim 1, and further comprising means for suspending the urn on a wall.

6. An urn as defined in claim 5, wherein said suspending means include a ring provided on said frame.

7. An urn as defined in claim 1, and further comprising means for supporting the urn on a horizontal surface.

8. An urn as defined in claim 7, wherein said supporting means include a supporting bracket provided on said rear protective sheet.

9. An urn for inhumation ashes, comprising a frame with a front area delimiting a large open space; an urn body adapted to store ashes; a graphic sheet located forwardly of said urn body; a transparent element located forwardly of said graphic sheet; and a rear protecting sheet arranged behind said urn body, said urn body, said graphic sheet, said transparent element and said rear protecting sheet being located inside said space of said frame, said urn body having two upright walls and a lower horizontal crossbar with two upright side struts which together delimit an inner space for storing the ashes, said urn body also having an upper crossbar which is movable between an open position in which it is removed so that the ashes can be introduced into the inner space and a closed position in which it is placed so as to close said inner space.

10. An urn as defined in claim 9, wherein said upper crossbar has upright stems which are provided with teeth and engageable into said upright side struts.

11. An urn as defined in claim 9, wherein said upright walls are transparent to allow viewing of the ashes.

* * * * *